US006679741B2

(12) United States Patent
Bland et al.

(10) Patent No.: US 6,679,741 B2
(45) Date of Patent: Jan. 20, 2004

(54) PROPULSION SYSTEM HAVING MEANS DEDICATED FOR DRIVING ACCESSORIES IN A BOAT

(75) Inventors: Gerald Francis Bland, Glenview, IL (US); Arthur R. Ferguson, Glenview, IL (US); Stephen R. Johnson, Waukegan, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/567,365

(22) Filed: May 9, 2000

(65) Prior Publication Data

US 2003/0232549 A1 Dec. 18, 2003

(51) Int. Cl.[7] ..... B63H 23/34
(52) U.S. Cl. ..... 440/83; 440/113
(58) Field of Search ..... 440/83, 88, 61, 440/113, 3, 6

(56) References Cited

U.S. PATENT DOCUMENTS

| | | | | | |
|---|---|---|---|---|---|
| 1,819,822 | A | * | 8/1931 | Grange | 440/88 |
| 3,025,824 | A | * | 3/1962 | Foster | 440/88 |
| 3,230,698 | A | * | 1/1966 | Nettles | 440/6 |
| 3,250,240 | A | * | 5/1966 | Ziegler | 440/6 |
| 3,589,204 | A | | 6/1971 | Langley | |
| 3,727,574 | A | | 4/1973 | Nils Olof Bagge | |
| 4,040,378 | A | | 8/1977 | Blanchard | |
| 4,236,478 | A | | 12/1980 | Mansson | |
| 4,302,196 | A | | 11/1981 | Blanchard | |
| 4,534,737 | A | * | 8/1985 | Henderson | 440/53 |
| 4,634,391 | A | | 1/1987 | Entringer et al. | |
| 4,741,675 | A | * | 5/1988 | Bowden | 417/295 |
| 5,151,059 | A | | 9/1992 | Higby | |
| 5,405,279 | A | | 4/1995 | Mastry et al. | |

FOREIGN PATENT DOCUMENTS

| | | | | |
|---|---|---|---|---|
| CA | 649901 | * | 10/1962 | 440/88 |
| GB | 2178712 | * | 2/1987 | 440/88 |

* cited by examiner

*Primary Examiner*—Ed Swinehart
(74) *Attorney, Agent, or Firm*—Ziolkowski Patent Solutions Group, LLC

(57) ABSTRACT

A propulsion system and method for driving one or more accessories in an outdrive of a boat having an engine coupled to a drive shaft to supply torque thereto are provided. The torque received by the drive shaft is principally used to propel the boat. The propulsion system includes a driven shaft dedicated to drive the one or more accessories, and further includes a gear assembly for passing a portion of the torque received by the drive shaft to the driven shaft so that each of the one or more accessories coupled to the driven shaft receives driving torque therefrom.

26 Claims, 2 Drawing Sheets

PROPULSION SYSTEM HAVING MEANS DEDICATED FOR DRIVING ACCESSORIES IN A BOAT

BACKGROUND OF THE INVENTION

The present invention is generally related to marine propulsion systems, and, more particularly, the present invention is related to a marine propulsion system having an auxiliary drive subsystem for driving one or more accessories in a watercraft.

Watercrafts, such as pleasure boats, etc., may include various mechanically-driven accessories, such as a power steering pump for hydraulically assisting an operator to steer the boat in a desired direction without undue exertion, a water pump for cooling the engine, a pump for supplying a lubricating fluid to a hydraulic transmission, an auxiliary alternator to electrically power key subsystems that would prevent a boat from being stranded in the event of a main alternator power failure, etc. Unfortunately, those various accessories may result in a proliferation of multiple components, such as pump mounting brackets, belt drives, pulleys, serpentine belts, etc., that combinedly could result in higher manufacturing and servicing costs and may increase the probability of mechanical breakdown due to the multiple components that may be required to drive such accessories.

In view of the foregoing issues, it would be desirable to provide an auxiliary drive subsystem that may be readily adaptable to drive such accessories regardless of distinct configurations that may occur in different types of boats, and without having to make unique pump mounting brackets, belt drives, pulleys, etc., for each configuration. It would be further desirable to provide an auxiliary drive system that at a low cost improves the overall reliability achieved with present designs for driving such accessories. It would be still desirable to provide a kit for directly driving the various accessories in the boat, and that allows for saving space in the boat and that may be readily serviced and maintained quickly and at low cost in fleets of deployed boats by authorized service centers.

SUMMARY OF THE INVENTION

Generally speaking, the present invention fulfills the foregoing needs by providing in one exemplary embodiment a propulsion system for a watercraft and wherein the propulsion system is configured to drive one or more accessories therein. The propulsion system, such as a stem drive, may comprise an engine, and a drive shaft for carrying torque supplied thereto by the engine. The torque carried by the drive shaft during normal engine operation may be principally used to propel the watercraft. The propulsion system may further include a driven shaft dedicated to drive the one or more accessories, and a gear assembly for passing a relatively minor portion of the torque carried by the drive shaft to the driven shaft, and wherein each of the one or more accessories is coupled to the driven shaft to receive driving torque therefrom.

In another aspect of the invention, the present invention provides a method for driving one or more accessories in an outdrive of a boat having an engine coupled to a drive shaft to supply torque thereto. The torque received by the drive shaft is principally used to propel the boat. The method allows for providing an auxiliary shaft or driven shaft dedicated to drive the one or more accessories. The method further allows for passing a portion of the torque received by the drive shaft to the auxiliary shaft through a gear assembly to supply driving torque to the one or more accessories coupled to the auxiliary shaft.

Figure 1:
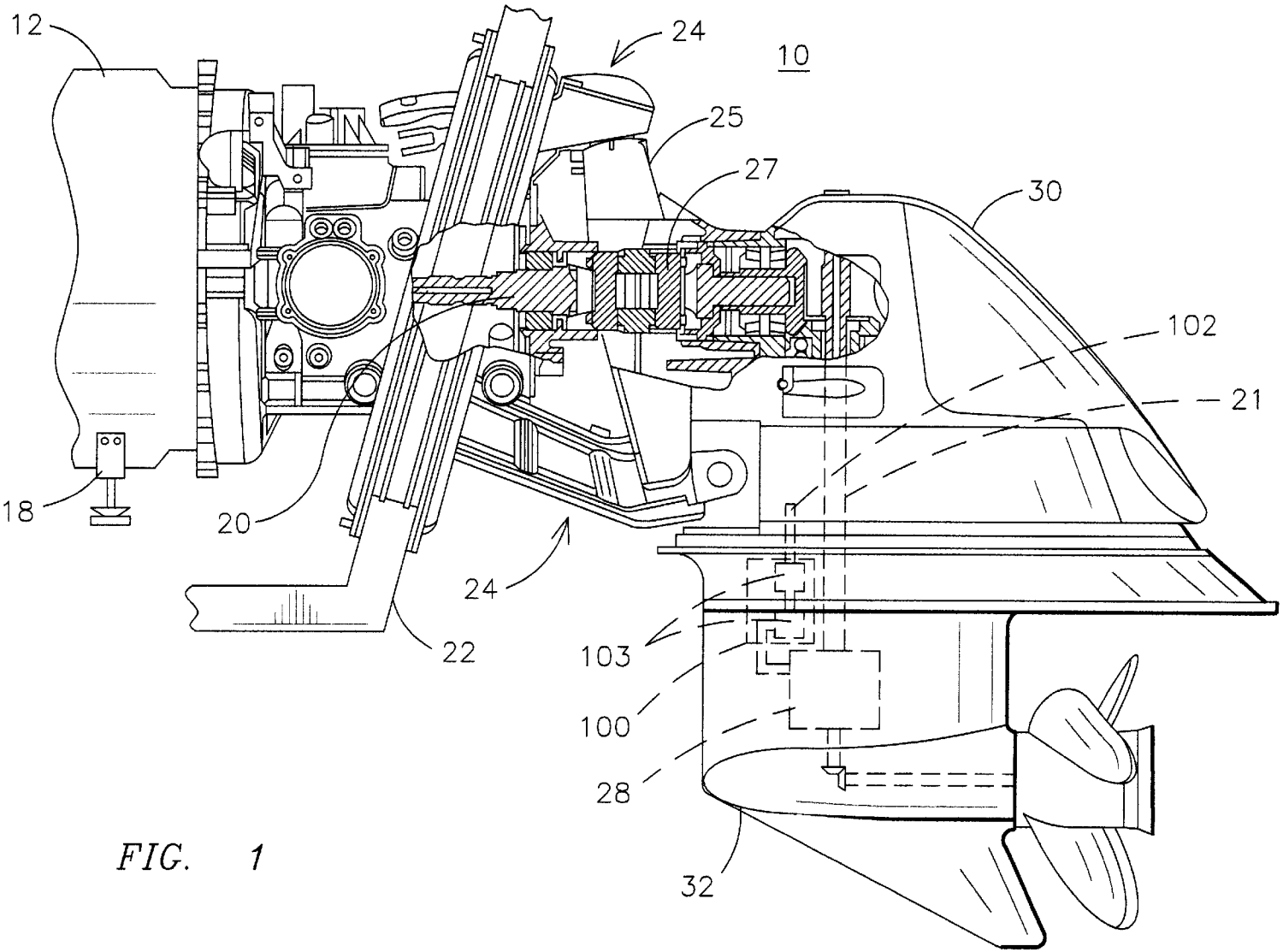
FIG. 1 is side view of an exemplary marine propulsion system in combination with an auxiliary drive subsystem for driving various accessories in a boat.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

FIG. 1 shows an exemplary marine propulsion system 10 that may benefit from the auxiliary drive system of the present invention. Marine propulsion system 10 is illustrated in FIG. 1 as having an engine 12 located within a boat having a transom 22. Standard engine mounts 18 may attach the engine 12 to the boat. The engine. 12 provides power through a crankshaft rotating at an engine revolution rate and outputs power to a drive shaft 20. The drive shaft 20 either extends through or is coupled through the transom 22 of the boat. A gimbal housing 24 is mounted to the exterior of the. transom 22. As will be readily understood by those skilled in the art, the gimbal housing supports a gimbal unit 25 that is horizontally pivotable to provide steering to the boat in a desired direction of travel and is further vertically pivotable to provide, for example, a desired trim relative to the water plane over which the boat travels. Gimbal unit 25 accommodates a universal joint 27 connected to the drive shaft 20 for allowing the vertical and horizontal pivoting. A transmission 28, such as a hydraulic automatic transmission, gears and driveshafts, shown in phantom lines within a vertical drive unit or outdrive 30, cooperate to transmit most of the power from the drive shaft 20 through an outdrive shaft 21 to a propeller shaft located in a torpedo housing 32 appended at the lower end of drive unit 30. As discussed in the context of FIG. 2 below, propulsion system 10 further includes an auxiliary drive subsystem 100 that receives a relatively minor portion of the power from drive shaft 20 through an auxiliary or driven shaft 102 dedicated to drive various accessories 103 that may be in the outdrive. As used herein, an accessory refers to any apparatus used in a boat or environment that singly or in combination with other such accessories uses a fraction of the torque supplied by the engine of the boat during normal operation, e.g., less than 50% of the total maximum torque that the engine is rated to supply during normal operation. By way of example and not of limitation, the accessories driven by the auxiliary drive subsystem may include mechanically-driven accessories, such as a water pump, a power steering pump, a transmission pump, an alternator, etc.

Figure 2:
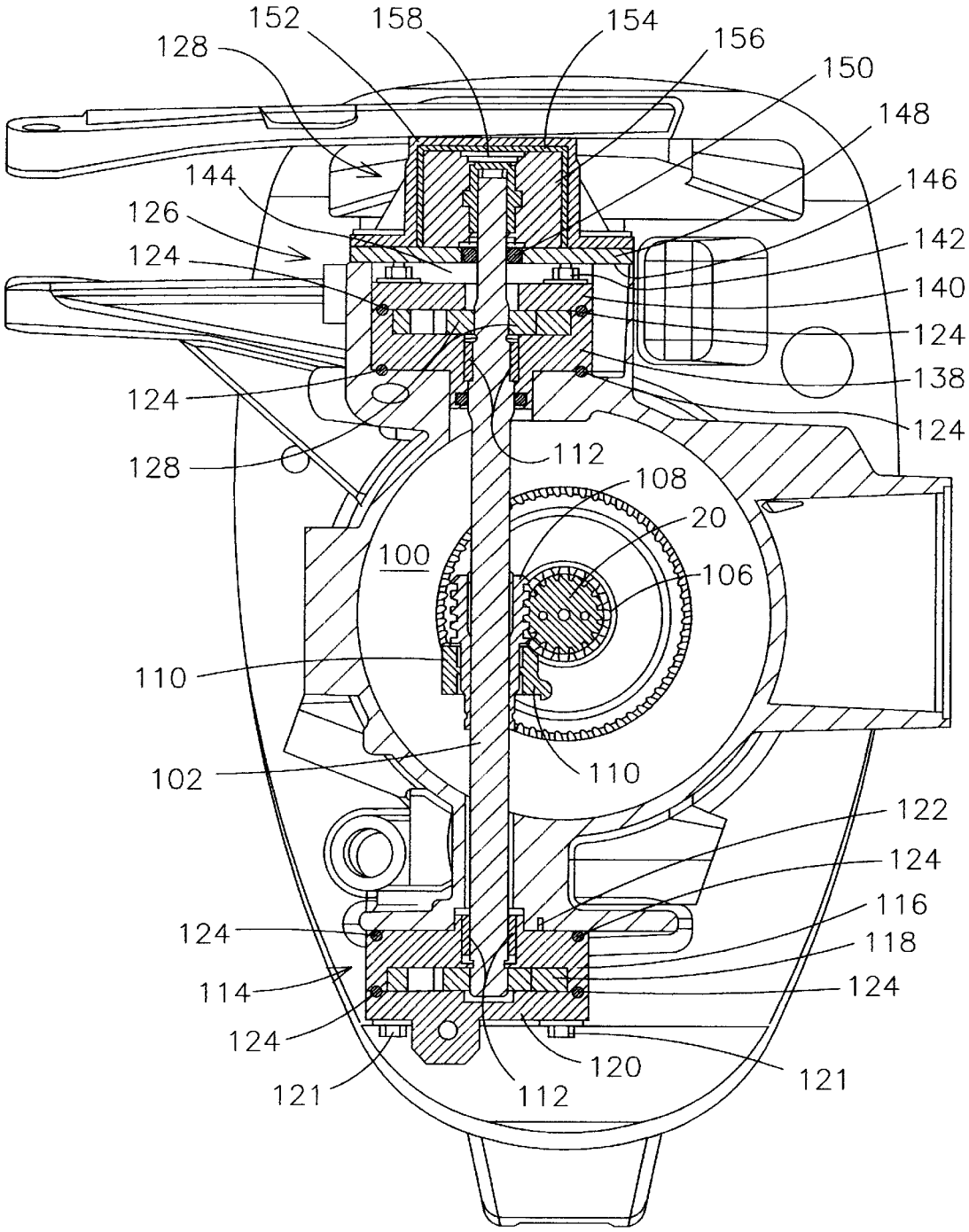
FIG. 2 is an elevational rear view of illustrating an exemplary arrangement of the auxiliary drive subsystem shown in FIG. 1.

FIG. 2 shows an exemplary embodiment of an auxiliary drive subsystem 100 for driving one or more accessories in the vertical drive unit or outdrive 30. "As suggested above, subsystem 100 comprises the drive or main shaft 20 mechanically coupled to the driven or auxiliary shaft 102 through a gear assembly 104 for passing a relatively minor portion of the maximum torque capable of being carried by drive shaft 20 to driven shaft 102, and wherein each of the one or more accessories, such as a transmission pump 114, a power steering pump 126, a water pump 128, etc., is in turn directly coupled to the driven shaft 102 to receive driving torque therefrom. As shown in FIG. 2, gear assembly 104 comprises a driving gear 106 mounted on drive shaft 20 and a corresponding driven gear 108 mounted on driven shaft 102. It will be appreciated by those skilled in the art, that gears 106 and 108 may be mounted on their respective supporting shafts through internal splines. Also, it will be appreciated that gears 106 and 108 may be integrally constructed in their respective supporting shafts, such as may be done using standard machining or casting techniques. Examples of the type of gears that may be used include standard helical, and bevel gears. Gear assembly 104 further comprises a bearing assembly 110 fixedly mounted onto outdrive 30 for rotatively supporting driven gear 108. By way of example and not of limitation, bearing assembly 110 is positioned generally intermediate relative to the opposite ends of driven shaft 102 to provide axial and radial support to driven gear 108 and in turn to driven shaft 102. Each opposite end or end section of shaft 102 may be supported radically by bearings 112, such as needle or roller bearings, mounted in respective ones of the accessory housings. It will be appreciated that the present invention is not limited to the specific combination of accessories and/or accessory locations illustrated in FIG. 2 since difference combinations of accessories and/or locations may be used depending on the requirements of any specific boat application. Further, it will be appreciated that the auxiliary drive subsystem of the present invention need not be limited to a vertically-driven subsystem since other geometrical arrangements including a horizontally-driven subsystem would work equally effective.

In the exemplary embodiment illustrated in FIG. 2, driven shaft 102 may drive at its lower end the transmission pump 114 enclosed in a respective transmission pump housing 116. Pump 114 may comprise an internal spline-driven gear pump 118 supported in housing 116. A removable plate 120 attached with bolts 121 may be provided to gain access to the interior of pump 114. Housing 116 may further contain an integral pressure relief by-pass valve 122. O-rings 124 allow for sealing pump housing 116 to prevent leakage of the fluid being pumped by pump 114 inside outdrive 30. It will be appreciated that an inlet of pump 114 may directly communicate with a transmission chamber in transmission 28 (FIG. 1) to provide suitable lubrication thereto.

As further shown in FIG. 2, an exemplary upper accessory arrangement may consist of two pumps, such as power steering pump 126 and water pump 128. Similar to lower pump 114, power steering pump 126 may comprise an internal spline-driven gear pump 127 in a respective pump housing 138 including a removable cover plate 140 attached to housing 138 with suitable connecting bolts or screws 142. Pumps 126 and 128 may be disposed in a reservoir chamber 144 that contains fluid, such as hydraulic fluid, that may be pumped by power steering pump 126, for example. In the exemplary embodiment of FIG. 2, a transmission pump 114 may be in fluid communication with reservoir chamber 144 being that the fluid pumped by transmission pump 114 and power steering pump 126 comprises the same fluid. It will be appreciated, however that in general each pump could draw a respective distinct fluid from separate fluid reservoirs. Reservoir chamber 144 in outdrive 30 may be sealed with a gasket 146 and an intermediate plate 148 that may include a lip seal 150 to prevent fluid leakage from pump housing 138 to the interior to the outdrive. Water pump 128 may comprise a plastic encasing 152 that encloses a stainless-steel jacket 154 that surrounds a water pump housing 156. The upper end of shaft 102 inside water pump housing 156 may include a suitable shaped impeller drive 158 that engages a flexible vane 160 that in operation causes circulation of water, or any suitable coolant fluid, for cooling the engine of the boat.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A propulsion system for a watercraft, said propulsion system comprising:

an engine;

a drive shaft for carrying torque supplied thereto by the engine, the torque carried by the drive shaft being principally used to propel the watercraft;

a driven shaft dedicated to drive a plurality of accessories coupled thereto;

a gear assembly for passing a portion of the torque carried by the drive shaft to the driven shaft, the torque portion passed by the gear assembly to the driven shaft being sufficient to drive the plurality of accessories coupled thereto;

wherein the plurality of accessories includes at least one of a lubrication pump, a power steering pump, and a water pump; and wherein the plurality of accessories are in fluid communication with the reservoir of fluid, and wherein the at least one of the plurality of accessories is disposed in a reservoir of fluid.

2. The propulsion system of claim 1 wherein the gear assembly further comprises a driving gear mounted on the drive shaft and a corresponding driven gear mounted on the driven shaft.

3. The propulsion system of claim 2 further comprising a bearing assembly mounted onto the drive unit for supporting the driven gear mounted on the driven shaft.

4. The propulsion system of claim 3 wherein the bearing assembly provides axial and radial support to the driven gear.

5. The propulsion system of claim 2 wherein the gear assembly further comprises a driving gear integrally constructed with the drive shaft and a corresponding driven gear integrally constructed with the driven shaft.

6. The propulsion system of claim 5 further comprising a bearing assembly for supporting the driven gear integrally constructed with the driven shaft.

7. The propulsion system of claim 6 wherein the bearing assembly provides axial and radial support to the driven gear.

8. The propulsion system of claim 2 wherein the driven shaft has opposite ends and the gear assembly is situated intermediate relative to the opposite ends of the driven shaft.

9. The propulsion system of claim 1 wherein the gear assembly comprises a driving gear and a corresponding driven gear and wherein each of said gears is selected from the group consisting of helical and bevel gears.

10. The propulsion system of claim 5 wherein the gear assembly includes a bearing assembly for radially supporting the driven shaft at its opposite ends.

11. The propulsion system of claim 1 wherein the plurality of accessories includes a water pump and wherein the water pump comprises an impeller coupled to drive a flexible vane.

12. The propulsion system of claim 1 further comprising a hydraulic pump and wherein the plurality of accessories includes a lubrication pump and wherein the lubrication pump and the hydraulic pump comprise respective gear pumps.

13. The propulsion system of claim 1 wherein the plurality of accessories includes a lubrication pump and wherein the lubrication pump is coupled to supply fluid to a transmission in a drive unit of the propulsion system.

14. The propulsion system of claim 1 wherein the plurality of accessories includes a power steering pump and a lubrication pump and wherein fluid pumped by the power steering pump and the lubrication pump comprises hydraulic fluid.

15.The propulsion system of claim 1 wherein the propulsion system is a stern drive.

16. A method for driving a plurality of accessories in an outdrive of a boat having all engine coupled to a drive shaft to supply torque thereto, the torque received by the drive shaft being principally used to propel the boat, said method comprising the steps of:

providing an auxiliary shaft dedicated to drive the plurality of accessories, the plurality of accessories including a lubrication pump, a power steering pump, and a water pump;

passing a portion of the torque received by the drive shaft to the auxiliary shaft through a gear assembly to provide driving torque to the plurality of accessories coupled to the auxiliary shaft;

arranging the power steering pump in a reservoir of fluid; and providing fluid communication between the lubrication pump, the power steering pump, and the reservoir of fluid.

17. The method of claim 16 wherein the auxiliary shaft has opposite ends and further comprising a step of positioning the gear assembly generally intermediate relative to the opposite ends of the auxiliary shaft.

18. The method of claim 17 further comprising radially supporting the auxiliary shaft at its opposite ends.

19. A propulsion system for a watercraft, the propulsion system comprising:

an engine;

a drive shaft for carrying torque supplied thereto by the engine, the torque carried by the drive shaft being principally used to propel the watercraft; and a gear assembly for passing a portion or the torque carried by the drive shaft to a driven shaft having opposite ends to drive at least one accessory at each end, the driven shaft being driven by the drive shaft at a point between the opposite ends; and wherein the driven shaft is dedicated to drive a plurality of accessories and is coupled to the gear assembly to transmit the torque portion passed by the gear assembly to the plurality of accessories, the plurality of accessories including a lubrication pump, a power steering pump, and a water pump; and wherein the power steering pump is disposed in a reservoir of fluid and the lubrication pump and the power steering pump are in fluid communication with the reservoir of fluid.

20. A propulsion system for a watercraft, said propulsion system comprising:

an engine;

a drive shaft for carrying torque supplied thereto by the engine, the torque carried by the drive shaft being principally used to propel the watercraft;

a propeller shaft directly mechanically coupled to an outdrive shaft;

a driven shaft having two drive ends configured to drive one or more accessories coupled thereto; and a gear assembly for passing a portion of the torque carried by the drive shaft to the driven shaft, the torque portion passed by the gear assembly to the driven shaft being sufficient to drive the one or more accessories coupled thereto, the gear assembly comprising a driving gear on the drive shaft and a corresponding driven gear on the driven shaft and wherein the driving gear is integrally constructed with the drive shaft and the corresponding driven gear is integrally constructed with the driven shaft.

21. A propulsion system for a watercraft, said propulsion system comprising:

an engine;

an outdrive shaft for carrying torque supplied thereto by a drive shaft, the torque carried by the outdrive shale being principally used to propel the watercraft;

a propeller shaft directly connected to the outdrive shaft;

a driven shaft connected to be driven by the drive shaft from a position other than an end of the driven shall and having one or more accessories coupled thereto and wherein at least one of said one or more accessories comprises a pump for propelling a respective fluid; and a gear assembly for passing a portion of the torque carried by the drive shaft to the driven shaft, the torque portion passed by the gear assembly to the driven shaft being sufficient to drive the one or more accessories coupled thereto.

22. The propulsion system of claim 21 wherein the one or more accessories are selected from the group consisting of a lubrication pump, a power steering pump, a water pump and an alternator.

23. A propulsion system for a watercraft, said propulsion system comprising:

an engine;

a drive shaft for carrying torque supplied thereto by the engine the torque carried by the drive shaft being principally used to propel the watercraft;

an outdrive shaft mechanically coupled to the drive shaft to translate power to a propeller shaft directly mechanically coupled to the outdrive shaft;

a driven shaft dedicated to drive a plurality of accessories coupled thereto and wherein at least one of said plurality of accessories comprises an electrical power generating device; and a gear assembly for passing a portion of the torque carried by the drive shaft to the driven shaft, the torque portion passed by the gear assembly to the driven shaft being sufficient to drive the plurality of accessories coupled thereto.

24. A propulsion system for a watercraft, said propulsion system comprising:

an engine;

a drive shall for carrying torque supplied thereto by the engine, the torque carried by the drive shaft being principally used to propel the watercraft;

an outdrive shaft mechanically coupled to the drive shaft;

a propeller shaft directly mechanically coupled to the outdrive shaft;

a driven shaft dedicated to drive one or more accessories coupled thereto, the driven shaft having opposite ends;

a gear assembly situated intermediate relative to the opposite ends of the driven shaft for passing a portion of the torque carried by the drive shaft to the driven shaft, the torque portion passed by the gear assembly to the driven shaft being sufficient to drive the one or more accessories coupled thereto, the gear assembly comprising a driving gear on the drive shaft and a corresponding driven gear on the driven shaft and wherein the driving gear is integrally constructed with the driven shaft; and a bearing assembly for axially and radially supporting the driven gear on the driven shaft.

25. A propulsion system for driving a plurality of accessories in an outdrive of a boat having an engine, an engine drive shaft coupled to an outdrive shaft to supply torque thereto, and wherein the outdrive shaft is directly coupled a propeller shaft the system comprising:

means for passing a portion of the torque received by the drive shaft to an auxiliary shaft dedicated to drive the plurality of accessories through a gear assembly; and means for coupling the plurality of accessories to the auxiliary shaft to receive driving torque therefrom.

26. An outdrive comprising:

an upper unit mountable to a gimbal housing;

a lower unit connected to the upper unit to translate power to a propeller extending from the lower unit;

a housing incorporating the upper unit and the lower unit therein;

a mid-section disposed between the upper unit and the lower unit and containing a drive shaft and at least one driven shaft mechanically coupled to the drive shaft such that the at least one driven shaft is in a plane transverse to that of the drive shaft; and a plurality of accessories, each driven by the at least one driven shaft and each located in the plane of the at least one driven shaft and wherein the plurality of accessories are enclosed in the housing of the outdrive.

* * * * *

UNITED STATES PATENT AND TRADEMARK OFFICE

CERTIFICATE OF CORRECTION

PATENT NO. : 6,679,741 B2
DATED : January 20, 2004
INVENTOR(S) : Bland et al.

It is certified that error appears in the above-identified patent and that said Letters Patent is hereby corrected as shown below:

Column 1,
Line 49, delete the word “stem” and substitute therefore -- stern --;

Column 6,
Line 30, delete the word “shall” and substitute therefore -- shaft --.

Signed and Sealed this

Sixteenth Day of March, 2004

JON W. DUDAS
*Acting Director of the United States Patent and Trademark Office*